United States Patent [19]

Imon et al.

[11] Patent Number: 4,962,816

[45] Date of Patent: Oct. 16, 1990

[54] ARRANGEMENT FOR CONTROLLING BULLDOZER BLADE

[75] Inventors: Kazutoshi Imon; Kensuke Fukushima, both of Komatsu; Hiroshi Shimizu, Kanazawa, all of Japan

[73] Assignee: Kabushiki Kaisha Komatsu Seisakusho, Tokyo, Japan

[21] Appl. No.: 348,482

[22] PCT Filed: Oct. 22, 1987

[86] PCT No.: PCT/JP87/00811

§ 371 Date: Apr. 19, 1989

§ 102(e) Date: Apr. 19, 1989

[87] PCT Pub. No.: WO88/03199

PCT Pub. Date: May 5, 1988

[30] Foreign Application Priority Data

Oct. 22, 1986 [JP] Japan ..... 61-251358

[51] Int. Cl.[5] ..... E02F 3/76

[52] U.S. Cl. ..... 172/821

[58] Field of Search ..... 172/811, 828, 818–823, 172/830; 37/117.5, DIG. 13, 283

[56] References Cited

U.S. PATENT DOCUMENTS

| | | | |
|---|---|---|---|
| 4,076,080 | 2/1978 | Anderson | 172/821 |
| 4,274,213 | 6/1981 | Yadlowsky | 37/117.5 |
| 4,424,871 | 1/1984 | Stickney | 172/821 |

FOREIGN PATENT DOCUMENTS

| | | | |
|---|---|---|---|
| 1115514 | 1/1982 | Canada | 172/821 |
| 45-19223 | 7/1970 | Japan . | |
| 57-38732 | 8/1982 | Japan . | |
| 58-53337 | 12/1983 | Japan . | |
| 59-91235 | 5/1984 | Japan . | |
| 59-144062 | 9/1984 | Japan . | |

*Primary Examiner*—Randolph A. Reese
*Assistant Examiner*—Jeffrey L. Thompson
*Attorney, Agent, or Firm*—Ronald P. Kananen

[57] ABSTRACT

The bulldozer blade control mechanism according to the present invention has a U-shaped frame (22) fixed to the lower intermediate portion of the rear surface of a blade (20) so that the frame (22) can be turned in all directions, left and right lifting and angling hydraulic cylinders (62, 64) respectively fixed pivotably to between the left and right portions of the rear surface of the blade and the left and right portions of a chassis via arms (36, 38), left and right pitching and tilting hydraulic cylinders (40, 42) respectively fixed pivotably to between those portions of the arms (36, 38) which are in the vicinity of the rear ends thereof and the left and right upper portions of the rear surface of the blade, and left and right levers (56, 58) respectively fixed pivotably to between the left and right parallel leg portions of the U-shaped frame (22) and either of left and right hydraulic cylinders (62, 64) and left and right arms (36, 38). The above-described arrangement enables the blade to make a total of eight movements, i.e. upward and downward movements, left and right angling movements, left and right tilting movements and forward and backward turning movements through the operations of the four hydraulic cylinders.

3 Claims, 4 Drawing Sheets

ARRANGEMENT FOR CONTROLLING BULLDOZER BLADE

TECHNICAL FIELD OF THE INVENTION

This invention relates to an arrangement for controlling the attitude or height of a blade of a bulldozer or the like by actuating a plurality of hydraulic cylinders.

BACKGROUND ART OF THE INVENTION

As for the prior art arrangement for controlling a bulldozer blade, there is, for example, one disclosed in U.S. Pat. No. 4,081,036. According to this prior art example, a bulldozer blade is connected to a U-shaped frame through a universal joint means in such a manner that it may be moved up and down, angled to the left and right, and tilted to the left and right relative to the U-shaped frame.

Briefly, by extending or retracting rods of a pair of lifting hydraulic cylinders in the same direction relative to each other, the U-shaped frame is turned vertically about a pair of left and right trunnion shafts for mounting the U-shaped frame onto the vehicle body, so that the blade is moved up and down while it is maintaining its horizontal position.

Further, when rods of a pair of left and right angling hydraulic cylinders are extended or retracted in opposite directions relative to each other, the blade is angled through the universal joint means to the left or to the right.

Further, when the rod of a tilting hydraulic cylinder mounted on the front end of the U-shaped frame substantially in parallel relationship with the blade is extended or retracted, the blade is tilted through a supporting means to the left or to the right.

Thus, the prior art arrangement for controlling a bulldozer blade comprises five hydraulic cylinders for controlling the operation of the blade. The arrangement is made such that by actuating the rods of the five hydraulic cylinders the blade can perform six operations, in total, i.e. upward and downward movements, angling to the left and right, and tilting to the left and right.

However, even by actuating the five hydraulic cylinders, the blade cannot be inclined forwardly or rearwardly as desired; that is, pitching operation of the blade cannot be conducted.

SUMMARY OF DISCLOSURE OF THE INVENTION

The present invention has been made in view of the above-mentioned situation in the prior art bulldozer blade controlling arrangement, and has as its object to provide an arrangement for controlling a bulldozer blade wherein the number of hydraulic cylinders can be reduced to achieve simplification of the construction thereof, and the blade can perform eight operations, in total, i.e., upward and downward movement, angling in the left and right directions, tilting in the left and right directions, and forward and rearward inclination, that is to say its the pitching operation.

To achieve the above-mentioned object, according to the first aspect of the present invention, there is provided an arrangement for controlling a bulldozer blade comprising: a U-shaped frame connected at the leading central part of the semi-circular portion thereof through a coupling means including a spherical shaft to the longitudinally substantially central and lower part of the rear surface of a blade in such a manner that the blade may be turned freely in all directions about said coupling means; a first arm and a second arm each being connected at one end through a bracket to the blade at two places on the rear surface thereof in such a manner that one end of each of the arms may be turned freely, said two places corresponding to left and right positions symmetrically of the longitudinally central part of the blade, at a height which is the same as the coupling means between the frame and the blade; a first hydraulic cylinder and a second hydraulic cylinder each being connected at one end through a bracket to the blade at two places on the upper part of the rear surface thereof which are vertically opposite to the connections between the arms and the blade in such a manner that one end of each of the cylinders may be turned freely; a first lever and a second lever each being connected at one end through a bracket to each of both parallel leg portions of said U-shaped frame, in such a manner that one end of each of the levers may be turned freely, at positions substantially between the leading end of the semi-circular portion of the frame and both the rear ends thereof which are each pivotally connected through a bracket to the vehicle body; a third hydraulic cylinder whose one end is pivotally connected to a connecting portion which connects pivotally the other ends of said first arm, said first hydraulic cylinder and said first lever, respectively, or alternatively, the portions of said first arm, said first hydraulic cylinder and said first lever, respectively in the vicinity of the other ends thereof, and whose other end is pivotally connected through a bracket to the vehicle body; and a fourth hydraulic cylinder whose one end is pivotally connected to a connecting portion which connects pivotally the other ends of said second arm, said second hydraulic cylinder and said second lever, respectively, or alternatively, the portions of said second arm, said second hydraulic cylinder and said second lever, respectively, in the vicinity of the other ends thereof, and whose other end is pivotally connected through a bracket to the vehicle body.

Further, according to the second aspect of the present invention, there is provided an arrangement for controlling a bulldozer blade, characterized by that said coupling means interposed between the rear surface of said blade and the leading end of the semi-circular portion of said U-shaped frame as set forth in said first aspect, which includes a sliding shaft which can be slidably moved freely by a predetermined distance in the axial direction.

Still further, according to the third aspect of the present invention, there is provided an arrangement for controlling a bulldozer blade, characterized by that said sliding shaft as set forth in the second aspect includes a means for thrusting said blade forwardly relative to said U-shaped frame according to the angle of angling when said blade is angled.

The above-mentioned and other advantages, manners and objects of the present invention will become apparent to those skilled in the art by reference to the following description and accompanying drawings in which preferred embodiments incorporating the principles of the present invention are shown by way of example only.

BRIEF DESCRIPTION OF ACCOMPANYING DRAWINGS

DESCRIPTION OF PREFERRED EMBODIMENTS

Figure 1:
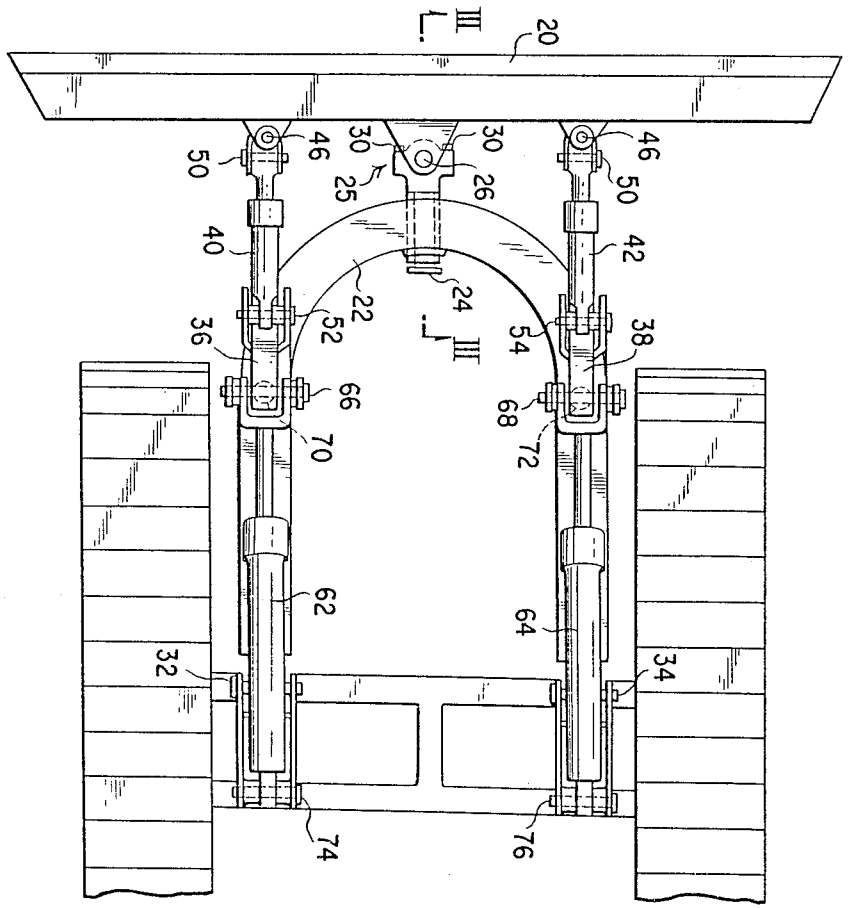
FIG. 1 is a schematic plan view showing one embodiment of the arrangement for controlling a bulldozer blade according to the present invention.
Figure 2:
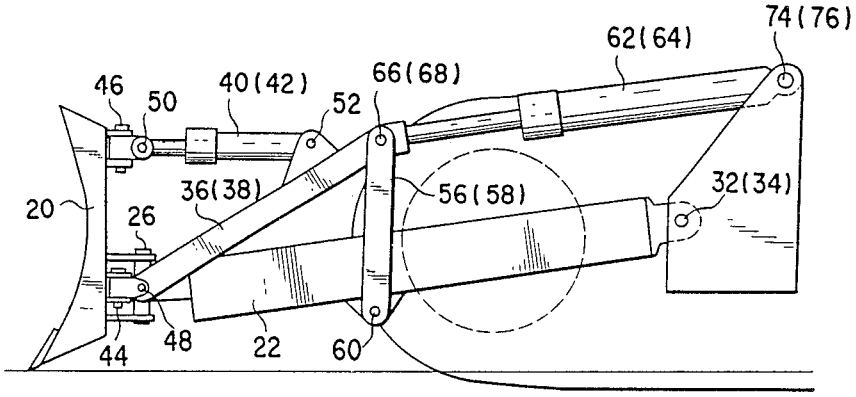
FIG. 2 is a schematic side elevational view of the embodiment shown in FIG. 1.
Figure 3:
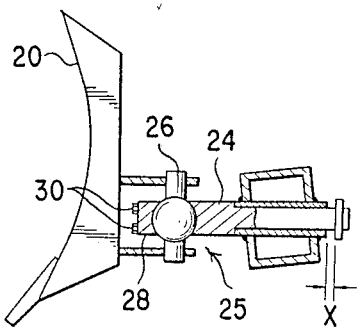
FIG. 3 is a schematic longitudinal sectional view taken along line III—III in FIG. 1.

FIGS. 1 and 2 are a schematic plan view and a schematic side elevational view, respectively, showing one embodiment of the arrangement for controlling a bulldozer blade according to the present invention. In these drawings, a blade 20 is shown mounted, at the longitudinally substantially central and lower part of the rear surface thereof, on a shaft 24 which passes through the central, leading end of the semi-circular portion of a U-shaped frame 22 so as to turn and slide freely, in such a manner that the blade may be turned freely relative to the shaft 24 in all directions. Briefly, as shown in FIG. 3, there is interposed between the blade 20 and the U-shaped frame 22 a coupling means 25 having a spherical shaft 26 fixedly secured through a bracket to the blade 20, and a cap 28 for mounting the spherical shaft 26 onto the leading end of the above-mentioned shaft 24 by means of a plurality of bolts 30 in such a manner that the spherical shaft 26 may be turned freely in all directions to thereby enable the blade 20 to turn freely in all directions relative to the shaft 24.

Whilst, the rear ends of both the leg portions of the U-shaped frame 22 which extend in parallel relationship with each other are pivotally mounted on trunnion shafts 32 and 34, respectively, which are each supported through a bracket fixedly secured to the vehicle body.

Further, left and right arms 36 and 38 are each connected through a bracket to the blade 20 at two places on the rear surface thereof in such a manner that one end of each of the arms may be turned freely, said two places corresponding to left and right positions symmetrically of the longitudinally central portion of the blade 20 at a height which is the same as that of the connecting portion of the spherical shaft 26 to the rear surface of the blade 20. Further the leading ends of the rods of the pitching and tilting hydraulic cylinders 40 and 42 are pivotally connected through a bracket to the upper part of the rear surface of the blade at two places vertically opposite to the connecting portions of these arms 36 and 38 to the blade 20. Further, connection of the arms 36, 38 and the hydraulic cylinders 40, 42 to the blade 20 is made by means of cross-joints formed, respectively, by a combination of vertical shafts 44, 46, and horizontal shafts 48, 50, each being supported by a bracket. Whilst, the base or trailing ends of the hydraulic cylinders are pivotally connected to the arms 36 and 38 through the intermediary of horizontal shafts 52 and 54 supported by brackets fixedly secured to the portions of the arms in the vicinity of their respective other ends.

Further, levers 56 and 58 are each pivotally connected through a bracket to each of the parallel leg portions of the U-shaped frame 22 at positions substantially between the leading end of the semi-circular portion of the U-shaped frame and both the rear ends of the legs thereof, respectively, which are pivotally connected to the vehicle body. The leading end of this lever 56 is pivotally connected by means of one and the same horizontal shaft 66 with the other end of the arm 36 and the leading end of the rod of the lifting and angling hydraulic cylinders 62, respectively, so that all of them may be turned freely relative to one another. Further, in the same manner, the leading end of the lever 58 is pivotally connected by means of one and the same horizontal shaft 68 with the other end of the arm 38 and the leading end of the rod of the lifting and angling hydraulic cylinder 64, respectively so they all may be turned freely relative to one another. Further, the other ends of the arms 36 and 38 are pivotally connected through spherical bushings 70 and 72 to the horizontal shafts 66 and 68, respectively, whilst the base or trailing ends of the hydraulic cylinders 62 and 64 are pivotally mounted on the vehicle body through shafts 74 and 76 supported by brackets fixedly secured to the vehicle body so that the hydraulic cylinders may be turned freely relative to the vehicle body.

Subsequently, the operation of the arrangement for controlling a bulldozer blade having the aforementioned construction according to the present invention will be described hereinbelow.

(1) Forward and Rearward Inclination of Blade:

In this case, the rods of the left and right pitching and tilting hydraulic cylinders 40 and 42 are extended or contracted at the same time. When the rods of the hydraulic cylinders 40, 42 are extended at the same time, the blade 20 is inclined forwardly about the spherical shaft 26, whilst when the rods of the hydraulic cylinders 40, 42 are contacted at the same time, the blade 20 is inclined rearwardly about the spherical shaft 26.

(2) Tilting of Blade to the Left and Right:

In this case, the rods of the above-mentioned hydraulic cylinders 40, 42 are extended and contracted, respectively, in opposite directions relative to each other. When the rod of the left hydraulic cylinder 40 is contracted and that of the right hydraulic cylinder 42 is extended, the blade 20 is tilted to the left; that is to say, the left end of the blade is lowered about the spherical shaft 26, and the right end thereof is raised. Whilst, when the rod of the left hydraulic cylinder 40 is extended and that of the right hydraulic cylinder 42 is contracted in the reverse manner to the aforementioned, the blade 20 is tilted to the right; that is to say, the left end of the blade is raised about the spherical shaft 26, and the right end thereof is lowered.

(3) Upward and Downward Movements of Blade:

In this case, the rods of the left and right lifting and angling hydraulic cylinders 62 and 64 are extended or contracted at the same time. When the rods of the hydraulic cylinders 62 and 64 are contracted at the same time, the U-shaped frame 22 is turned upwardly about the trunnion shafts 32 and 34 with the result that the blade 20 is moved upwardly. Further, when the rods of the hydraulic cylinders 62 and 64 are extended at the same time, the U-shaped frame 22 is turned downwardly about the trunnion shafts 32 and 34, resulting in the lowering of the blade 20.

(4) Angling of Blade to the Left and Right:

In this case, the piston rods of the above-mentioned hydraulic cylinders 62 and 64 are extended and contracted, respectively, in opposite directions relative to each other. When the rod of the left hydraulic cylinder 62 is contracted and that of the right hydraulic cylinder 64 is extended, the lever 56 is allowed to fall rearwardly so as to move the left side of the blade 20 rearwardly through the arm 36 and the hydraulic cylinder 40. The lever 58 is also allowed to fall forwardly so as to move the right side of the blade 20 forwardly through the arm 38 and the hydraulic cylinder 42 so that the blade 20 is angled to the left. Further, when the rod of the left hydraulic cylinder 62 is extended and that of the right hydraulic cylinder 64 is contracted, the lever 56 is allowed to fall forwardly so as to move the left side of the blade 20 forwardly through the arm 36 and the hydraulic cylinder 40. The lever 58 is also allowed to fall rearwardly so as to move the right side of the blade 20 rearwardly through the arm 38 and the hydraulic cylinder 42 so that the blade 20 is angled to the right.

Further, during the above-mentioned angling operation of the blade 20, the levers 56 and 58 are allowed, respectively, to make a circular-arc motion about the shaft 60. Thus, when the left and right levers 56 and 58 are allowed to make a circular-arc motion about the shaft 60 by the same angle in the reverse directions from their substantially vertically standing positions as shown in FIG. 2, the shafts 66 and 68, extending through the upper ends of the levers 56 and 58, are moved downwardly by approximately the same amount. The effect of this change in position of the shafts 66, 68 on the attitude of the blade can be absorbed by the forward movement of the shaft 24 which is fitted in the leading end of the U-shaped frame 22 in such a manner that it may be slidably moved within a predetermined distance X, and also by the rearward inclination of the blade 20 to some degree.

Further, the amount of sliding movement of the above-mentioned shaft 24 is as small as ten and several millimeters and does not cause any problem in practice during the upward movement of the blade. However, when the blade is moved upwardly, the shaft 24 is once slidably moved to its rear end position and then moved upward, and therefore the sliding movement of the shaft 24 causes a time lag.

Figure 4:
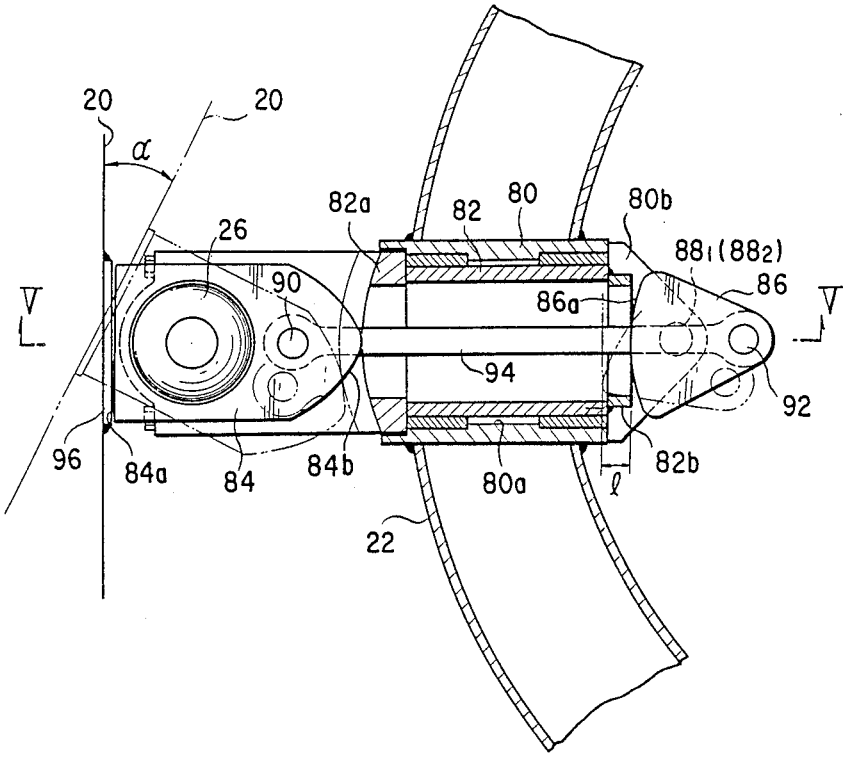
FIG. 4 is a schematic plan view which includes a partial horizontal section, showing another embodiment of the connecting portion of a bulldozer blade and a U-shaped frame.
Figure 5:
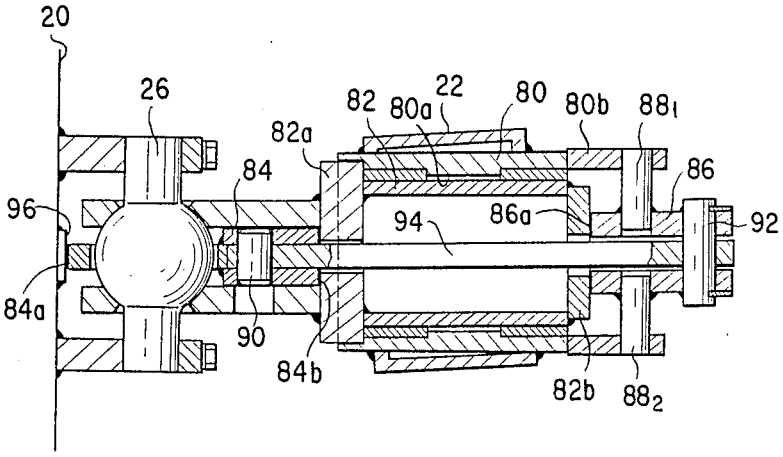
FIG. 5 is a schematic longitudinal sectional view taken along line V—V in FIG. 4.

One example of the arrangement for eliminating the time lag and correcting the attitude of the blade during the angling operation is shown in FIGS. 4 and 5.

Referring to these drawings, fixedly secured to the leading end of the semi-circular portion of the U-shaped frame 22 is a cylindrical bearing unit 80 having a flange portion **80*a* formed in the approximately central part thereof. Further, a cylindrical member 82 is fitted in this cylindrical bearing unit 80 through bushings in such a manner that it maybe turned and slidably moved freely. The blade 20 is pivotally connected through the spherical shaft 26 on the leading end of this cylindrical member 82 so that it may be turned freely. Further, this cylindrical member 82 has cams 84 and 86** mounted on the leading and rear ends thereof, respectively.

The cam 84 is mounted so that it may be turned freely about the spherical shaft 26, whilst the cam 86 is mounted so that it may be turned freely about shafts $88_1$ and $88_2$ mounted on a support **80*b* fixedly secured to the rear end of the cylindrical bearing unit 80. Shafts 90 and 92 are provided, respectively, at positions spaced away from the turning centres of these cams 84 and 86. The shafts 90 and 92 are interconnected by means of a link 94**.

The leading end face **84*a* of the cam 84 adjoining to the blade 20 is brought into contact with a reinforcing plate 96 welded to the rear surface of the blade, whilst the rear end cam face 84*b* of the cam 84 is brought into contact with the front surface of a flange portion 82*a* of the cylindrical bearing member 82. Further, the cam face 86*a* of the cam 86 is brought into contact with the rear surface of a cover 82*b* secured fixedly to the rear end of the cylindrical member 82. Accordingly the sliding movement of the cylindrical member 82 relative to the cylindrical bearing unit 80 is limited by the cams 84 and 86** mounted in the front and in the rear thereof.

When the blade 20 is angled by an angle $\alpha$ to the right as shown by an imaginary line in FIG. 4, the cam 84 is also turned by the angle $\alpha$ about the spherical shaft 26. As a result of the turning of this cam 84, the cam face **86*a* of the cam 86 is turned through the intermediary of the link 94 by the same angle o in the reverse direction so as to push or urge against the rear surface of the cover 82*b*. Consequently, the cylindrical member 82 and the blade 20 connected thereto are moved forwardly relative to the U-shaped frame 22** by a distance "l". The attitude of the blade at the time of the angling operation is corrected by this movement.

In the same manner, when the blade 20 is returned from the above-mentioned angled conditions to its original non-angled condition, the cams 84 and 86 are returned to their original positions so that the cam face **86*a* of the cam 86 is moved away from the rear end surface of the cover 82*b* of the cylindrical member 82, whilst the rear end cam face 84*b* of the cam 84 pushes or urges against the front end surface of the flange portion 82*a* of the cylindrical member 82 so that the cylindrical member 82 and the blade 20** connected thereto are moved rearwardly by the distance "l".

By constructing the connecting portion of the U-shaped frame 22 and the blade 20 as mentioned above, the attitude of the blade during the angling operation is corrected. In addition, since the U-shaped frame 22 is always kept into contact with the cylindrical member 82 through the cams 84 and 86, the aforementioned time lag does not occur.

Figure 6:
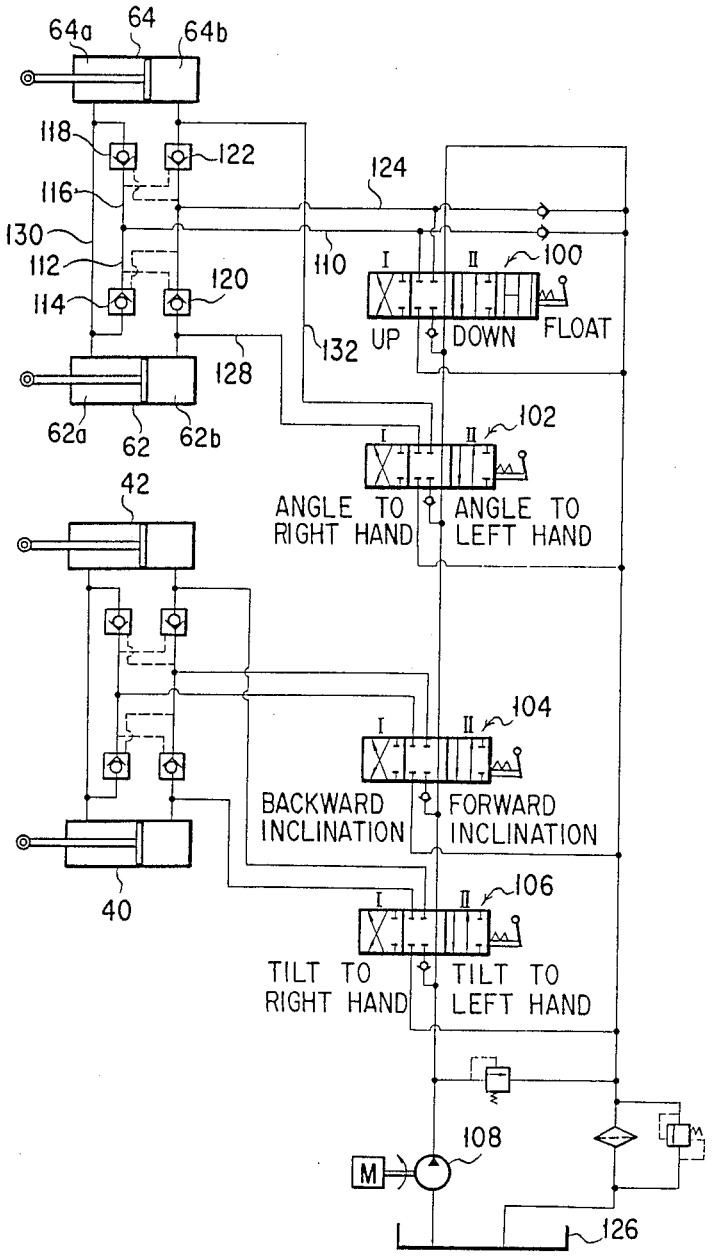
FIG. 6 is a block diagram showing one embodiment of the hydraulic operating circuit for use in the arrangement for controlling a bulldozer blade according to the present invention.

In the next instance, one example of the hydraulic circuit including the above-mentioned four hydraulic cylinders 40, 42, 62 and 64 will be described with reference to FIG. 6. As shown in FIG. 6, this hydraulic circuit includes a lifting hydraulic control value 100, an angling hydraulic control valve 102, a pitching hydraulic control valve 104, and a tilting hydraulic control valve 106.

In the first place, movement of the blade up and down by operating the lifting hydraulic control valve 100 will be described below. When the hydraulic control valve 100 is switched over to its position I, fluid under pressure is supplied from a hydraulic pump 108 through fluid passages 110 and 112 and a pilot type check valve 114 into a fluid chamber **62*a* of the left lifting and angling hydraulic cylinder 62, and also through fluid passages 110 and 116 and a pilot type check valve 118 into a fluid chamber 64*a* of the right lifting and angling hydraulic cylinder 64. Whilst, with the increase in the fluid pressure within the fluid passages 112 and 116, the pilot type check valves 120 and 122 are opened with the result that the fluid under pressure in fluid chambers 62***b* and 64*b* of the hydraulic cylinders 62 and 64 is introduced through the check valves 120 and 122, respectively, the fluid passage 124 and the hydraulic control valve 100 into a drain 126. Consequently, both the piston rods of the hydraulic cylinders 62 and 64 are contracted thereby moving the blade upwardly. Further, when the hydraulic control valve 100 is switched over to its position II, the fluid under pressure will flow in the reverse direction to that in the above-mentioned case extending both the rods of the hydraulic cylinders 62 and 64 and thereby moving the blade downwardly.

In the next instance, the operation of the hydraulic control valve 102 will be described. When the hydraulic control valve 102 is switched over to its position I, fluid under pressure is supplied from the hydraulic pump 108 through the hydraulic control valve 102 and a fluid passage 128 into the fluid chamber 62*b* of the hydraulic cylinder 62, and the fluid under pressure in the fluid chamber 62*a* of the hydraulic cylinder 62 is supplied through a fluid passage 130 into the fluid chamber 64*a* of the hydraulic cylinder 64. Further, the fluid under pressure in the fluid chamber 64*b* of the hydraulic cylinder 64 is introduced through a fluid passage 132 and the hydraulic control valve 102 into the drain 126. As a result, the rod of the hydraulic cylinder 62 is extended and the rod of the hydraulic cylinder 64 is contracted so that the blade 20 is angled to the right as mentioned above. Further, when the hydraulic control valve 102 is switched over to its position II, fluid under pressure will flow in the reverse direction to that in the above-mentioned case extending the rod of the hydraulic cylinder 64 and contracting the rod of the hydraulic cylinder 62, with the result that the blade 20 is angled to the left.

Further, the hydraulic control valves 104, 106 and the hydraulic circuits extending from these hydraulic control valves to the pitching and tilting hydraulic cylinders 40, 42 are arranged in the same manner as the above-mentioned hydraulic control valves 100, 102 and the hydraulic circuits extending from these hydraulic control valves to the lifting and angling hydraulic cylinders 62, 64.

Thus, when the hydraulic control valve 104 is switched over to its position I, both the rods of the hydraulic cylinders 40 and 42 are contracted thereby inclining the blade rearwardly. Further, when the hydraulic control valve 104 is switched over to its position II, both the rods of the hydraulic cylinders 40 and 42 are extended thereby inclining the blade forwardly.

Whilst, when the hydraulic control valve 106 is switched over to its position I, the rod of the hydraulic cylinder 40 is extended and the rod of the hydraulic cylinder 42 is contracted with the result that the blade is tilted to the right. Further, when the hydraulic control valve 106 is switched over to its position II, the rod of the hydraulic cylinder 42 is extended and the rod of the hydraulic cylinder 40 is contracted with the result that the blade is tilted to the left.

Further, in the above-mentioned embodiments of the present invention, the shaft 24 is fitted in the leading end of the U-shaped frame 22 in such a manner that it may be slidably moved freely as shown in FIG. 3, or, alternatively, the arrangement is made such that the shaft 82 is fitted in the leading end of the U-shaped frame 22 so that it may be moved rearwardly according to the angle of angling of the blade. However the shafts 24 and 82 may be arranged so as not to slidably move and move forwardly and backwardly.

In this case, however, during the angling operation, the blade is inclined forwardly or rearwardly and tilted to some degree, due to the changes in the height of the upper ends of the left and right levers 56 and 58, in addition to the angling thereof. Further, it is needless to say that some degree of forward and rearward inclination and tilting of the blade can be corrected properly by controlling the hydraulic cylinders 40 and 42 as mentioned above.

We claim:

1. An arrangement for controlling a bulldozer blade comprising: a U-shaped frame connected at the leading central part of the semi-circular portion thereof through a coupling means including a spherical shaft to the longitudinally substantially central and lower part of the rear surface of a blade in such a manner that the blade may be turned freely in all directions about said coupling means; a first arm and a second arm each being connected at one end through a bracket to the blade at two places on the rear surface thereof in such a manner that said one end of each of the arms may be turned freely, said two places corresponding to left and right positions symmetrically of the longitudinally central portion of the blade at a height which is the same as that of the coupling means between the frame and the blade; a first hydraulic cylinder and a second hydraulic cylinder each being connected at one end through a bracket to the blade at two places on the upper part of the rear surface thereof which are vertically opposite to the connections between the arms and the blade in such a manner that said one end of each of the cylinders may be turned freely; a first lever and a second lever each being connected at one end through a bracket to each of both parallel leg portions of said U-shaped frame, in such a manner that said one end of each of the levers may be turned freely, at positions substantially between the leading end of the semi-circular portion of the frame and both the rear ends thereof which are each pivotally connected through a bracket to the vehicle body; a third hydraulic cylinder whose one end is pivotally connected to a connecting portion which connects pivotally the other ends of said first arm, said first hydraulic cylinder and said first lever, respectively, or alternatively the portions of said first arm, said first hydraulic cylinder and said first lever, respectively, in the vicinity of the other ends thereof, and whose other end is pivotally connected through a bracket to the vehicle body; and a fourth hydraulic cylinder whose one end is pivotally connected to a connecting portion which connects pivotally the other ends of said second arm, said second hydraulic cylinder and said second lever, respectively, or alternatively the portions of said second arm, said second hydraulic cylinder and said second lever, respectively, in the vicinity of the other ends thereof, and whose other end is pivotally connected through a bracket to the vehicle body.

2. An arrangement for controlling a bulldozer blade as claimed in claim 1, characterized in that said coupling means interposed between the rear surface of said blade and the leading end of the semi-circular portion of said U-shaped frame includes a sliding shaft which can be slidably moved freely by a predetermined distance in the axial direction.

3. An arrangement for controlling a bulldozer blade as claimed in claim 1, characterized by that said sliding shaft includes a means for thrusting said blade forwardly relative to said U-shaped frame according to the angle of angling when said blade is angled.

* * * * *